US010060126B2

(12) United States Patent
Collins

(10) Patent No.: US 10,060,126 B2
(45) Date of Patent: Aug. 28, 2018

(54) STARTER STRIP

(71) Applicant: TY-DAS BUILDING PRODUCTS, LLC, Miamitown, OH (US)

(72) Inventor: P. Michael Collins, Cincinnati, OH (US)

(73) Assignee: TY-DAS BUILDING PRODUCTS, LLC, Miamitown, OH (US)

( * ) Notice: Subject to any disclaimer, the term of this patent is extended or adjusted under 35 U.S.C. 154(b) by 0 days.

(21) Appl. No.: 15/427,225

(22) Filed: Feb. 8, 2017

(65) Prior Publication Data

US 2017/0226732 A1 Aug. 10, 2017

Related U.S. Application Data

(60) Provisional application No. 62/293,009, filed on Feb. 9, 2016.

(51) Int. Cl.

| | |
|---|---|
| ***E04B 1/76*** | (2006.01) |
| ***E04B 2/28*** | (2006.01) |
| ***E04F 19/02*** | (2006.01) |
| ***E04B 2/02*** | (2006.01) |
| *E04F 13/04* | (2006.01) |

(52) U.S. Cl.

CPC ..... *E04B 2/28* (2013.01); *E04B 1/765* (2013.01); *E04B 2/02* (2013.01); *E04F 19/02* (2013.01); *E04B 2002/028* (2013.01); *E04B 2002/0232* (2013.01); *E04B 2002/0258* (2013.01); *E04F 13/04* (2013.01)

(58) Field of Classification Search

CPC ..... E04D 13/0459; E04D 2013/0468; E06B 2001/628; E04B 1/7046; E04B 1/7038; E04F 19/02

USPC ..... 52/58, 62, 302.6

See application file for complete search history.

(56) References Cited

U.S. PATENT DOCUMENTS

| | | | |
|---|---|---|---|
| 1,746,816 | A | 2/1930 | Boes |
| 1,954,730 | A | 4/1934 | Erickson |
| 1,970,326 | A | 8/1934 | Larson |
| 2,122,926 | A | 7/1938 | Blacher |
| 2,147,035 | A | 2/1939 | Henderson |

(Continued)

FOREIGN PATENT DOCUMENTS

| | | | | |
|---|---|---|---|---|
| JP | 05112989 | A | * | 5/1993 |
| JP | 2009030272 | A | * | 2/2009 |

*Primary Examiner* — Adriana Figueroa

(74) *Attorney, Agent, or Firm* — Wood Herron & Evans LLP

(57) ABSTRACT

A starter strip for through-wall-flashing of a cement-based exterior finish and hard siding includes a flashing membrane and a body. The flashing membrane has an inner surface that includes first and second inner surface portions containing self-adhering adhesive. The first inner surface portion is configured to permanently attach to at least one wall substrate. The body includes a first vertical leg having an inner surface attached to the second inner surface portion of the flashing membrane. The first vertical leg includes upper and a lower portions. The body also includes a second vertical leg and an outwardly and downwardly projecting leg extending between the lower portion of the first vertical leg and the second vertical leg. The outwardly and downwardly projecting leg includes first and second pluralities of spaced apertures, configured to relieve cavity air pressure and drain water from the body, respectively.

17 Claims, 5 Drawing Sheets

(56) References Cited

U.S. PATENT DOCUMENTS 2,154,734 A 4/1939 Doing
2,298,319 A 10/1942 Vatet
2,329,585 A 9/1943 Brewer
2,715,887 A 8/1955 Xanten
2,905,072 A * 9/1959 Oswald ..... E04B 1/7076 454/276
2,934,931 A 5/1960 Johnson
3,283,460 A 11/1966 Patrick
3,287,866 A 11/1966 Bevilacqua
3,293,810 A 12/1966 Cox et al.
3,445,322 A 5/1969 Saila et al.
3,562,892 A 2/1971 Laneri
3,585,766 A 6/1971 Jamieson
3,654,765 A 4/1972 Healy et al.
3,668,829 A 6/1972 Nelson
3,754,362 A 8/1973 Daimler et al.
3,812,634 A 5/1974 Resech
3,852,925 A 12/1974 Gazzo
3,888,087 A 6/1975 Bergsland
3,919,815 A 11/1975 Alabaster
4,045,964 A 9/1977 Barclay
4,245,443 A 1/1981 Beechen
4,282,691 A 8/1981 Risdon
4,333,281 A 6/1982 Scarfone
4,381,630 A 5/1983 Koester
4,404,777 A 9/1983 Lolley et al.
4,439,956 A 4/1984 House
4,486,986 A 12/1984 Cosenza
4,612,742 A 9/1986 Bevilacqua
4,622,138 A 11/1986 Wager
4,704,048 A 11/1987 Ahlgrimm
4,730,953 A 3/1988 Tarko
4,745,716 A 5/1988 Kuypers
4,862,320 A 8/1989 Schmidt et al.
4,869,032 A 9/1989 Geske
4,907,385 A 3/1990 Biodrowski
4,910,931 A 3/1990 Pardue, Jr.
4,943,185 A 7/1990 McGuckin et al.
4,986,699 A 1/1991 Bohnhoff
5,027,572 A * 7/1991 Purcell ..... E04B 1/66 52/309.9
5,044,821 A 9/1991 Johnsen
5,115,614 A 5/1992 McGrath
5,189,853 A 3/1993 Braine et al.
5,199,233 A 4/1993 Fukutomi et al.
5,218,793 A 6/1993 Ball
5,230,189 A 7/1993 Sourlis
5,263,792 A 11/1993 Davis et al.
5,274,968 A 1/1994 Pardo
5,343,661 A 9/1994 Sourlis
5,349,792 A 9/1994 Bayes
5,598,673 A 2/1997 Atkins
5,630,299 A 5/1997 Jackman et al.
5,644,891 A 7/1997 Kafarowski
5,692,348 A 12/1997 Ambrosino
5,694,723 A 12/1997 Parker
5,771,643 A 6/1998 Parker
5,794,388 A 8/1998 Jackman
5,815,986 A 10/1998 Laska
5,836,135 A * 11/1998 Hagan ..... E04B 1/762 52/302.3
5,845,455 A 12/1998 Johnson, III
5,857,297 A 1/1999 Sawyer
5,860,259 A 1/1999 Laska
5,927,023 A 7/1999 Kittilstad
5,937,594 A 8/1999 Sourlis
5,970,667 A 10/1999 Thaler
6,023,892 A 2/2000 Sourlis
6,048,132 A 4/2000 Kupke et al.
RE36,676 E 5/2000 Sourlis
6,112,476 A 9/2000 Schulenburg
6,119,416 A 9/2000 Larson
6,119,429 A * 9/2000 Bifano ..... E04B 1/765 52/101
6,131,353 A 10/2000 Egan
6,134,847 A * 10/2000 Bifano ..... E04B 1/765 52/101
6,182,412 B1 * 2/2001 Traxler ..... A01M 1/24 428/36.2
6,205,724 B1 3/2001 Garling et al.
6,224,700 B1 5/2001 Oakley
6,238,766 B1 5/2001 Massett et al.
6,244,001 B1 6/2001 Anastasi
6,256,955 B1 7/2001 Lolley et al.
6,293,064 B1 * 9/2001 Larson ..... E04B 1/762 52/209
6,298,609 B1 * 10/2001 Bifano ..... E04B 1/765 52/101
6,308,470 B1 10/2001 Durkovic
6,355,333 B1 3/2002 Waggoner et al.
6,410,118 B1 6/2002 Reicherts et al.
6,574,930 B2 6/2003 Kiser
6,591,559 B2 * 7/2003 Contreras ..... E04B 1/762 43/1
6,715,237 B2 4/2004 Batt, Sr.
6,892,499 B1 5/2005 Mayle
6,964,136 B2 11/2005 Collins et al.
7,037,864 B2 5/2006 Faucher
7,222,462 B2 5/2007 Ellingson
7,421,826 B2 9/2008 Collins et al.
7,543,414 B2 * 6/2009 Sourlis ..... E04B 1/70 52/169.5
7,546,719 B1 * 6/2009 Guevara ..... E04F 13/06 52/302.6
7,591,106 B2 9/2009 Conlin
7,621,079 B2 11/2009 Takagi et al.
7,634,883 B1 * 12/2009 Larson ..... E04F 13/06 52/393
7,673,421 B2 * 3/2010 Pilz ..... E04F 13/06 52/302.6
7,900,404 B2 3/2011 Koch et al.
8,046,956 B1 * 11/2011 Hohmann, Jr. ..... E02D 31/02 428/349
8,468,750 B2 * 6/2013 Clearfield ..... E04B 1/70 52/58
8,522,508 B1 * 9/2013 Collins ..... E04B 1/7046 52/209
2001/0023565 A1 9/2001 Snider et al.
2003/0177712 A1 9/2003 Gatherum
2003/0177736 A1 9/2003 Gatherum

* cited by examiner

STARTER STRIP

CROSS REFERENCE TO RELATED APPLICATION

This application claims the priority of U.S. Provisional Patent Application Ser. No. 62/293,009 filed on Feb. 9, 2016, the entire disclosure of which is hereby incorporated by reference herein.

TECHNICAL FIELD

This disclosure relates generally to a starter strip for commercial and residential structures and, more particularly, to a starter strip and associated method of through-wall-flashing of a cement-based exterior finish and hard siding.

BACKGROUND

Traditionally, starter strips are used along the bottom of and for a variety of cement based exterior finishes where those finishes interface with a lower wall or intersecting roof, balcony, or deck structure. As an independent fixture, a starter strip is nothing more than a straight edge closure/guide for the exterior finish. Trade Associations and code officials promote/dictate the concept that water is to be directed from the interface between a structural wall and its exterior finish via a through-wall-flashing. Building codes state that through-wall-flashing should be installed along the base of a cavity and where ever the drainage plane is interrupted. Starter strips, as a stand-alone fixture, do not provide a singular way to start and through wall flash with a singular piece. This means that after a starter strip has been installed, another flashing step is to follow.

Furthermore, Building Envelope Consultants review building plans for tie-in connections of through wall flashings with foundation waterproofing membranes, deck-plaza- and balcony waterproofing, and roofing membranes. Tie-in connections are important to the overall effectiveness of air and water barrier protections. The fewer products and trades involved, the better the outcome.

As a result, there exists a need for a starter strip that lessens the chance of faulty installation by reducing the number of products and trades involved in correctly executing flashing, tie-in connection and starter strip work. Additionally, there exists a need for a starter strip that is suitable for both commercial and residential structures and adaptable to a variety of supporting wall substrates and wall assembly thickness dimensions encountered in through-wall-flashing cement based exterior finishes and hard siding.

SUMMARY

In accordance with an exemplary embodiment, a starter strip for through-wall-flashing of a cement-based exterior finish and hard siding includes a flashing membrane and a body. The flashing membrane has an inner surface that includes first and second inner surface portions containing self-adhering adhesive. The first inner surface portion is configured to permanently attach to at least one wall substrate to form a first waterproof seal. The body includes a first vertical leg having an inner surface attached to the second inner surface portion of the flashing membrane to form a second waterproof seal. The first vertical leg includes an upper portion and a lower portion. The body also includes a second vertical leg and an outwardly and downwardly projecting leg extending between the lower portion of the first vertical leg and the second vertical leg. The outwardly and downwardly projecting leg includes first and second pluralities of spaced apertures. The first plurality of spaced apertures is disposed adjacent the lower portion of the first vertical leg. The first plurality of spaced apertures is configured to relieve cavity air pressure. The second plurality of spaced apertures is disposed adjacent the second vertical leg. The second plurality of spaced apertures is configured to drain water from the body.

In accordance with an exemplary embodiment, a starter strip for through-wall-flashing of a cement-based exterior finish and hard siding includes a flashing membrane and a rigid body. The flashing membrane has an inner surface that includes first and second inner surface portions containing self-adhering adhesive. The first inner surface portion is configured to permanently attach to the structural wall to form a first waterproof seal. The lower first inner surface portion is dimensioned to counter flash/tie-in with existing or later applied waterproofing/roofing membranes. The rigid body includes a vertical leg having an inner surface attached to the second inner surface portion of the flashing membrane which forms a continuous (second) waterproof seal. The vertical leg includes an upper and lower portion. The upper portion extends outward and upward and the lower portion extends outward and downward with its most forward portion bent upward to be a finished edge/finish guide. The upper portion will be a sealant receiver that when filled with sealant will terminate the flashing and transition water draining over the face of the structure onto the face of the body. The lower portion is sloped to receive water moving over the vertical leg and drain it through a plurality of spaced apertures. The first plurality of spaced apertures is disposed on the sloped portion adjacent the lower portion of the vertical leg. The first plurality of spaced apertures is configured to be directly under a cavity space where it can effectively vent the cavity space, its primary function, when it is not draining water. The second plurality of spaced apertures is disposed on the sloped portion adjacent the forward and upturned finished edge/guide. The second plurality of spaced apertures is configured to drain water from the lower portion.

A method of installing the starter strip for through-wall-flashing of a cement-based exterior finish and hard siding is also described. The method includes providing a starter strip. The starter strip includes a flashing membrane and a body. The flashing membrane has an inner surface that includes first and second inner surface portions containing self-adhering adhesive. The body includes first and second vertical legs. The first vertical leg has an inner surface attached to the second inner surface portion of the flashing membrane to form a second waterproof seal. The first vertical leg includes an upper portion and a lower portion. An outwardly and downwardly projecting leg extends between the lower portion of the first vertical leg and the second vertical leg. The outwardly and downwardly projecting leg includes first and second pluralities of spaced apertures. The first plurality of spaced apertures is disposed adjacent the lower portion of the first vertical leg and is configured to relieve cavity air pressure. The second plurality of spaced apertures is disposed adjacent the second vertical leg and is configured to drain water from the body. The method also includes permanently attaching the first inner surface portion to at least one wall substrate to form a first waterproof seal. The method also includes dispensing a bead of sealant between the upper portion of the first vertical leg and the at least one wall substrate. The bead of sealant is configured to direct water to the plurality of spaced apertures.

A method of installing the starter strip for through-wall-flashing of cement-based exterior finishes and hard siding is also described. The method includes providing a starter strip, which includes a flashing membrane. The flashing membrane has an inner surface that includes first and second inner surface portions containing self-adhering adhesive. The first inner surface portion is dimensioned to counter flash/tie-in with lower existing or later applied waterproofing/roofing membranes. The starter strip has a rigid body with upper and lower outwardly extending portions. The rigid body has an inner surface attached to the second inner portion of the flashing membrane to form a second waterproof seal. The lower and outwardly-downwardly projecting portion of the rigid body includes first and second pluralities of spaced apertures. The first plurality of spaced apertures is disposed on the downwardly projecting portion adjacent the lower portion of the rigid body and is configured primarily to relieve cavity air pressure (by being directly below a wall cavity space) and secondarily to drain water. The second plurality of spaced apertures is disposed on the same projecting portion and adjacent a forward and upturned finished edge/guide and is configured to drain water. The method also includes permanently attaching the first inner surface over and to wall substrates to form a first waterproofing seal. Fasteners are not required for permanent attachment, which is a benefit to related air barrier systems. The method also includes dispensing a bead of sealant between the upper portion of the rigid body and related substrates. The bead of sealant is configured to direct water to the plurality of spaced apertures. The method also includes dispensing a bead of sealant along continuing joints, and along ends and terminal lower edge of the flashing membrane.

These and other objects and advantages of the disclosed starter strip and method of installing the starter strip will become more readily apparent during the following detailed description taken in conjunction with the drawings herein.

BRIEF DESCRIPTION OF THE DRAWINGS

The above-mentioned and other features and advantages, and the manner of attaining them, will become more apparent and better understood by reference to the following description of embodiments taken in conjunction with the accompanying drawings, wherein.

DETAILED DESCRIPTION

Figure 1:
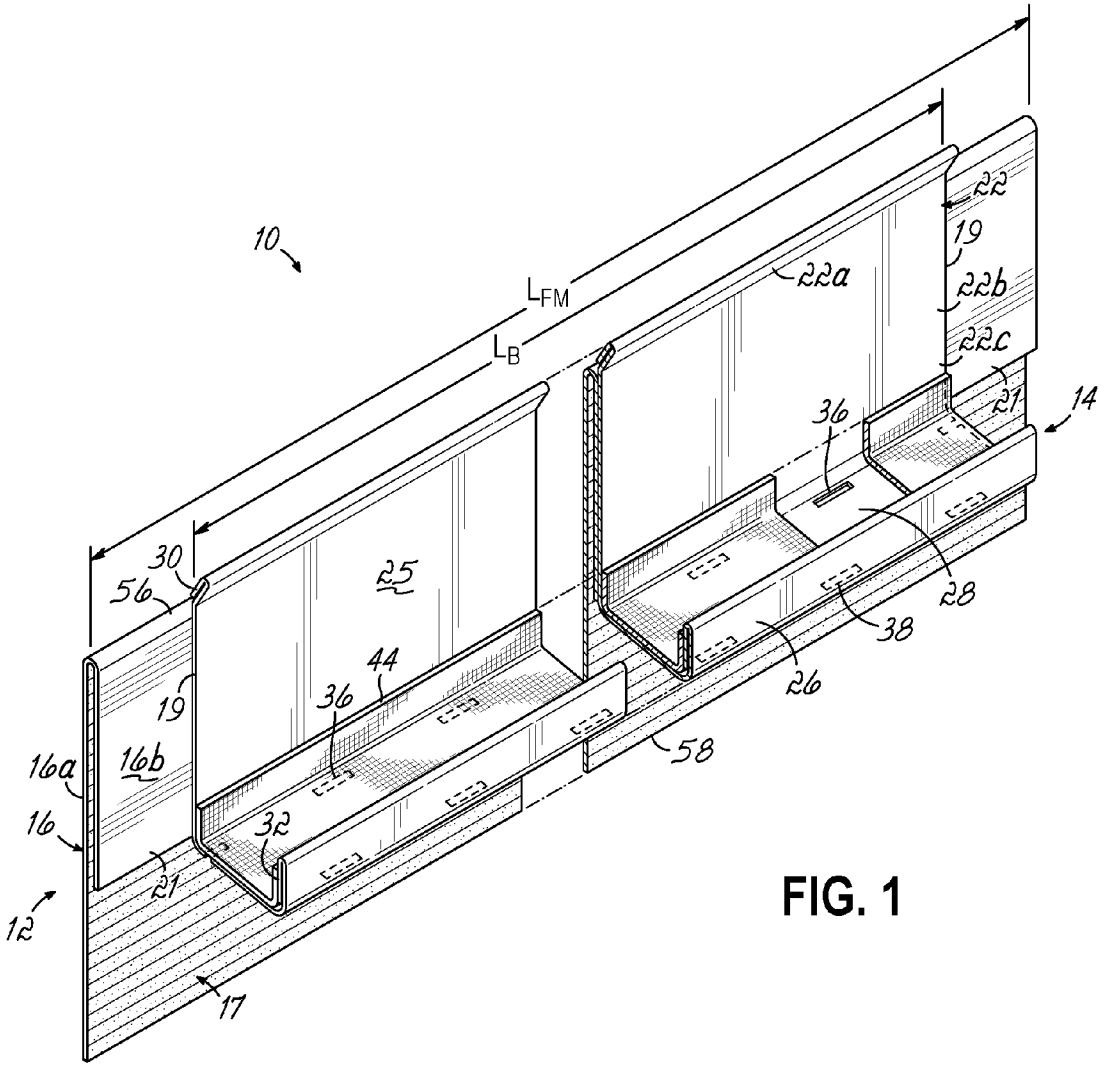
FIG. 1 is a schematic perspective view of an exemplary embodiment.
Figure 2:
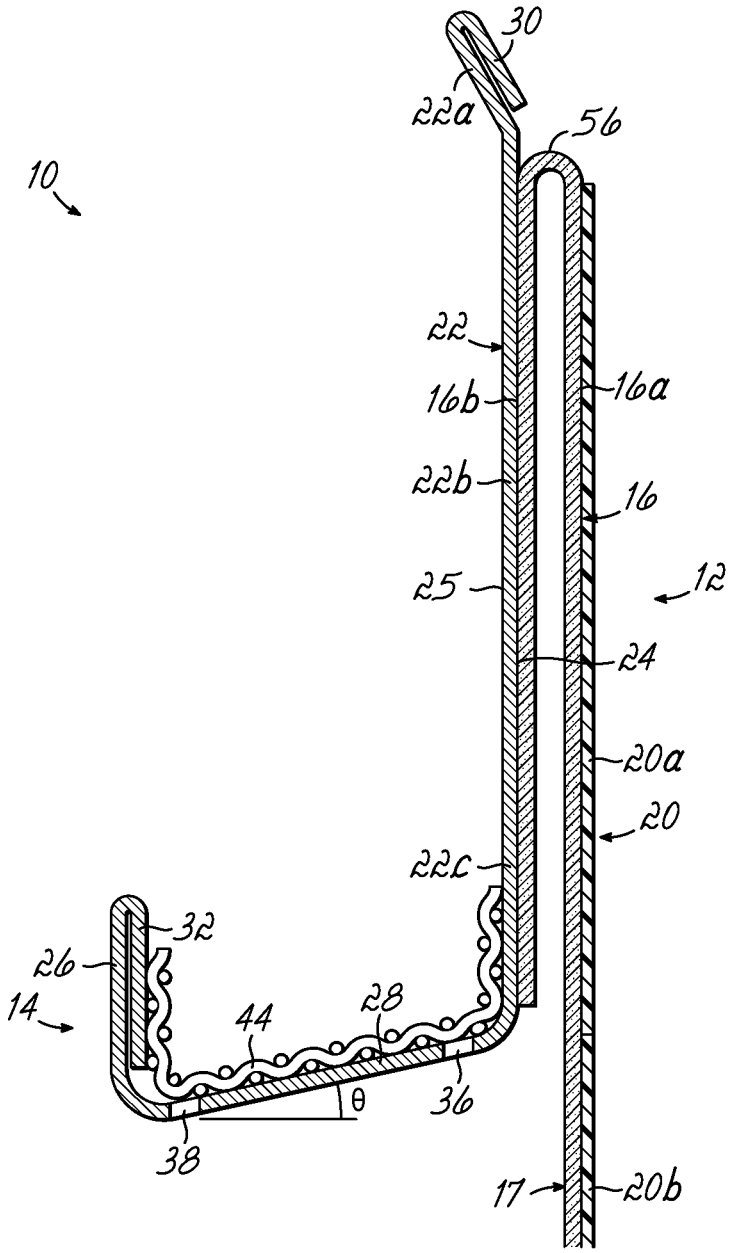
FIG. 2 is a schematic cross-sectional view of an exemplary embodiment similar to FIG. 1.
Figure 3:
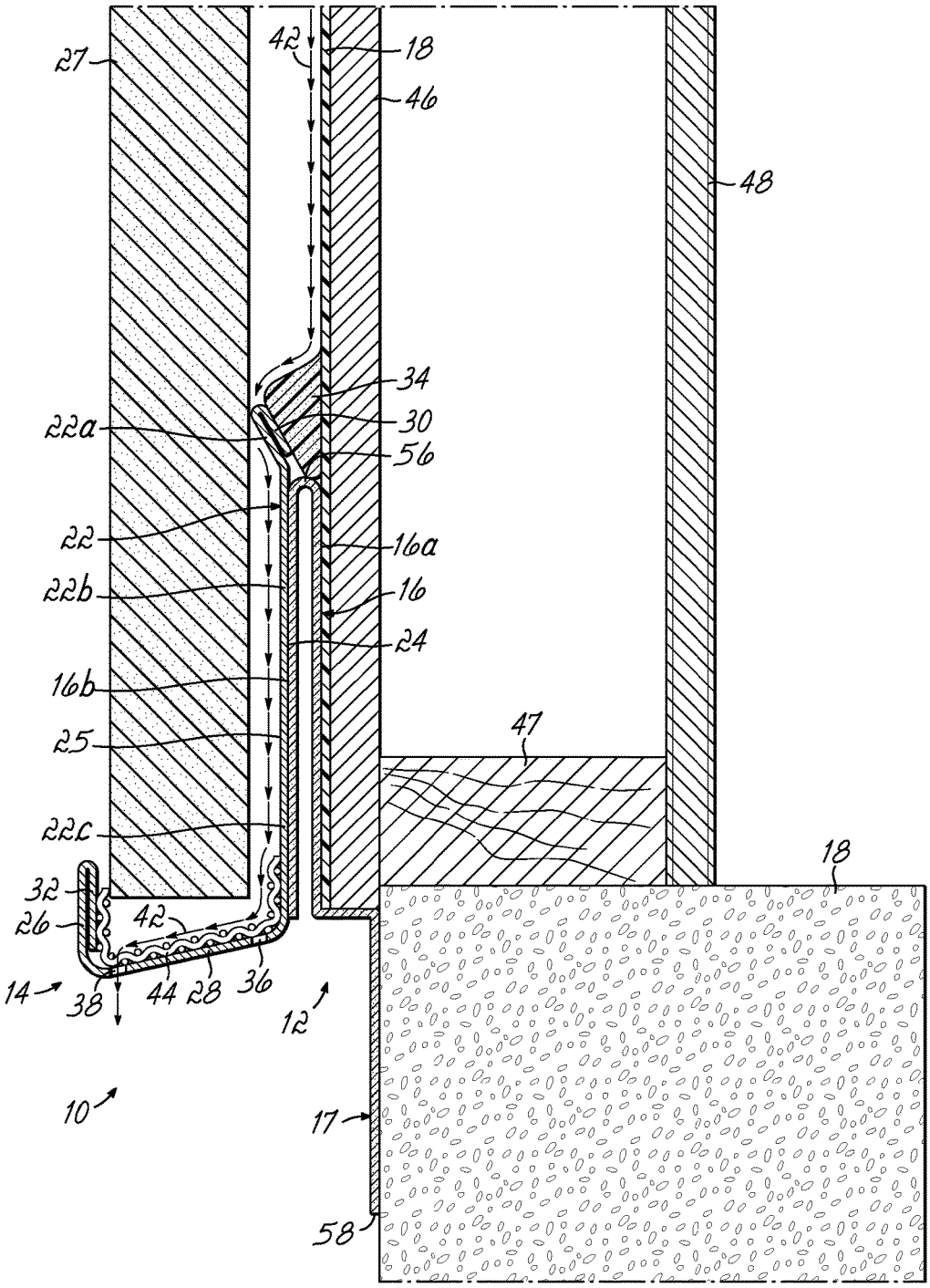
FIG. 3 is a schematic cross-sectional view of the starter strip in a finished installation according to another exemplary embodiment.

As shown in FIGS. 1-3, a starter strip 10 includes a flashing membrane 12 and a body 14. In some embodiments, the starter strip 10 is intended to be a starter strip and through-wall-flashing for cement-based exterior finishes and hard siding, while in other embodiments, the starter strip 10 is intended to be a combination termite and insect guard, starter strip, and through-wall-flashing for cement-based exterior finishes and hard siding. As used herein, cement-based exterior finishes may include, for example, stucco, tile, adhered manufactured stone veneer (also known as adhered masonry veneer), thin brick veneer, brick metal panel and/or stone metal panels, as well as other cement-based exterior finishes that would be appreciated by those skilled in the art. It is also envisioned that starter strip 10 may be used with hard siding. As used herein, hard siding may include, for example, wood siding and composite siding. For example, in an embodiment, the starter strip 10 may be an integral starter strip for use with drainage lath cavity counter wall sheets in their application for rain screen and pressure equalized rain screen wall assemblies. The starter strip 10 may be used in conjunction with both commercial and residential applications. Additionally, the starter strip 10 may be used in conjunction with newly constructed structures as well as for structures undergoing remodeling/renovation. The function, benefits, and structural features of starter strip 10, including the flashing membrane 12 and body 14, are described in turn below in connection with the respective drawings.

As shown in FIGS. 1-3, the flashing membrane 12 has an inner surface 16 and an outer surface 17. The inner surface 16 includes first and second inner surface portions 16*a*, 16*b* containing self-adhering adhesive. The first inner surface portion 16*a* is configured to permanently attach to at least one wall substrate 18 to form a first waterproof seal. As used herein, the wall substrate 18 may include, for example, exterior sheathing, a cementitious material, and/or other wall substrate materials known to a person skilled in the art, and may be covered in part by and air and vapor barrier material (such as those described by the Air Barrier Association of America).

According to an exemplary embodiment, the self-adhering adhesive disposed on the inner surface 16 is butyl based, however, persons skilled in the art would appreciate that a variety of self-adhering adhesives are also suitable. For example, butyl-based adhesives are compatible with about 95% of the wall substrates 18, allowing for adhesion to a variety of underlying surfaces. The inner surface 16 of the flashing membrane 12 may be covered by a release paper 20 configured to protect the self-adhering adhesive prior to the desired use. The release paper 20 may be slit, either entirely or using perforations, to enable removal in first and second independent sections 20*a*, 20*b*, when desired. Alternatively, one continuous sheet (not shown) of release paper 20 may be used.

The flashing membrane 12 may extend beyond each terminal edge 19 of the body 14 to allow for adhesion of an adjoining flashing membrane 12 enabling lineal continuation of protection. As shown in FIG. 1, the flashing membrane 12 has a length ($L_{FM}$) that is greater than the length ($L_B$) of the body 14, creating an overhang portion 21 of the flashing membrane 12. In an exemplary embodiment, the flashing membrane 12 has a length ($L_{FM}$) of 8'4", while the body 14 has a length ($L_B$) of 8', resulting in an overhang portion 21 of 2" on each terminal edge 19 of the body 14.

As shown in FIGS. 1-3, the body 14 includes a first vertical leg 22 having an inner surface 24 attached to the second inner surface portion 16*b* of the flashing membrane 12 to form a second waterproof seal. According to an exemplary embodiment, the inner surface 24 of the first vertical leg 22 may be sold permanently attached to the second inner surface portion 16*b* of the flashing membrane 12, which may prevent faulty installation or installations where the second waterproof seal does not remain permanent. The first vertical leg 22 includes an upper angled portion 22*a*, a middle portion 22*b*, and a lower portion 22*c*. The body 14 may also include a second vertical leg 26. The body 14 includes an outwardly and downwardly projecting leg 28 extending between the lower portion 22*c* of the first vertical leg 22 and the second vertical leg 26. In one embodiment, the first vertical leg 22 may have a 4" vertical dimension with the upper angled portion having a ⅜" vertical dimension and the second vertical leg 26 having a ⅝" vertical dimension.

While the orientation of the starter strip 10 in FIGS. 1-3 is with relation to a vertically disposed starter strip and through-wall-flashing for vertical cement-based exterior finishes and hard siding, persons skilled in the art would appreciate that the orientation of the starter strip 10 may be different when applied to an angled wall surface. As a result, some of the components that recite a specific orientation, such as the first vertical leg 22 or the second vertical leg 26 may be non-vertical as well.

While not shown, the body 14 may be provided in a variety of different forms, which may account for different thicknesses of the cement-based exterior finish 27 (shown in FIG. 3). For example, for Termite and Insect Starter Strips (TIGS) 0100, the outwardly and downwardly projecting leg 28 has a 1" horizontal dimension. Similarly, for TIGS 0150, the outwardly and downwardly projecting leg 28 has a 1½" horizontal dimension, and for TIGS 0200, the outwardly and downwardly projecting leg 28 has a 2" horizontal dimension. Similarly, for TIGS 0250, the outwardly and downwardly projecting leg 28 has a 2½" horizontal dimension, and for TIGS 0300, the outwardly and downwardly projecting leg 28 has a 3" horizontal dimension. However, other dimensions are also envisioned.

According to an exemplary embodiment, for cement-based exterior finishes, the body 14 may be formed substantially from galvanized steel or stainless steel, while for hard siding, the body 14 may be formed substantially from aluminum. For example, the body 14 may be G90 galvanized steel having 60% post-industrial recycled content. As shown in FIGS. 1-3, the body 14 is integrally formed as a unitary piece, however, persons skilled in the art would appreciate that the body 14 may be formed from multiple pieces attached together, using a variety of manufacturing processes.

The outwardly and downwardly projecting leg 28 may include first and second pluralities of spaced apertures 36, 38. As shown, the first plurality of spaced apertures 36 is disposed adjacent the lower portion 22*c* of the first vertical leg 22 and is aligned at least partially below the air cavity. The first plurality of spaced apertures 36 is configured to relieve cavity air pressure that builds up between the body 14 and the cement-based exterior finish 27. The first plurality of spaced apertures 36 acts as an air and/or water passage allowing air to vent resulting in more efficient water evacuation. The second plurality of spaced apertures 38 is disposed adjacent the second vertical leg 26, and may be spaced, according to an exemplary embodiment, 8" apart and ⅛" away from the first vertical leg 22. The second plurality of spaced apertures 38 is configured to drain water from the body 14, due to the downward sloping shape of the outwardly and downwardly projecting leg 28. The second plurality of spaced apertures 38 may be spaced, according to an exemplary embodiment, 8" apart and ⅛" away from the second vertical leg 26. Persons skilled in the art would appreciate that the outwardly and downwardly projecting leg 28 may be disposed at a range of suitable angles (θ) to allow water to suitably drain from the body 14. The path 42 the water may travel is shown in FIG. 3 using a series of arrows. According to an exemplary embodiment, the first plurality of spaced apertures 36 are spaced in a first row of identical rectangles, while the second plurality of spaced apertures 38 are spaced in a second row of identical rectangles.

As shown in FIGS. 1-3, the starter strip 10 may also include a mesh 44 that is attached by sealant to at least the outwardly and downwardly projecting leg 28. The mesh 44 is intended to cover at least the first and second pluralities of spaced apertures 36, 38 to allow the water to drain, while preventing termites and other insects from passing through. The mesh 44 may be omitted if protection against termites and other insects is not desired or for other reasons. As shown in FIGS. 1-3, the mesh 44 is permanently attached by sealant to the first vertical leg 22, the outwardly and downwardly projecting leg 28, and the second vertical leg 26 by setting the mesh 44 in an adhesive. The openings in the mesh are intended to be small enough to prevent terminates from passing, but large enough to allow water to escape.

In an exemplary embodiment, the mesh 44 is made of metal, and in particular, a stainless steel mesh filter fabric. The stainless steel mesh filter fabric is not a food source for termites and insects serves as a physical deterrent. The flashing membrane 12, the body 14, and the mesh 44 may include a layer of stainless steel to prevent termites and other insects from passing through. For example, the flashing membrane 12 may include 304 stainless steel self-adhered-flashing for an inland application, while the flashing membrane 12 may include 316 stainless steel for coastal applications. In the example of serving as a physical deterrent, if a terminate or other insect attempts to crawl up the outer surface 17 of the flashing membrane 12, the termite or other insect after reaching the top continuous fold 56 would be forced to crawl back down the outer surface 17 of the flashing membrane 12 that is attached to the first vertical leg 22 of the body 14.

As shown in FIGS. 1-3, the upper angled portion 22*a* of the first vertical leg 22 includes a folded over portion 30, and the second vertical leg 26 includes a folded over portion 32. The folded over portion 30 of the first vertical leg 22 extends outwards to form a channel to receive the bead of sealant 34 (shown in FIG. 3). In other words, the folded over portion 30 of the upper angled portion 22*a* of the first vertical leg 22 is bent inwards to become a sealant receiver.

As shown in FIG. 3, the starter strip 10 may also include a bead of sealant 34 disposed in a cavity between the upper angled portion 22*a* of the first vertical leg 22 and the at least one wall substrate 18. The bead of sealant 34 acts to shed water from the outer surface of the wall substrate 18 to the outer surface 25 of the body 14, as shown by the path 42 of water in FIG. 3. The bead of sealant 34 is configured to direct water to at least one of the first and second pluralities of spaced apertures 36, 38 which prevents water from accumulating. Additionally, the bead of sealant 34 protects the butt joint between adjoining bodies 14 from termite penetration as will be described in relation to FIGS. 4 and 5. Persons skilled in the art would appreciate that a wide variety of sealants may be utilized that provide adequate adhesion to the body 14 and wall substrate 18. The bead of sealant 34 may be shaped with a tool (not shown), such as a spatula, while pliable. As shown in FIG. 3, the wall substrate 18 may be attached to external sheathing 46, such as a sheet of plywood. The structure may also include a sill plate 47, such as a wooden sill plate, and an internal sheathing 49, such as a sheet of plywood.

Figure 4:
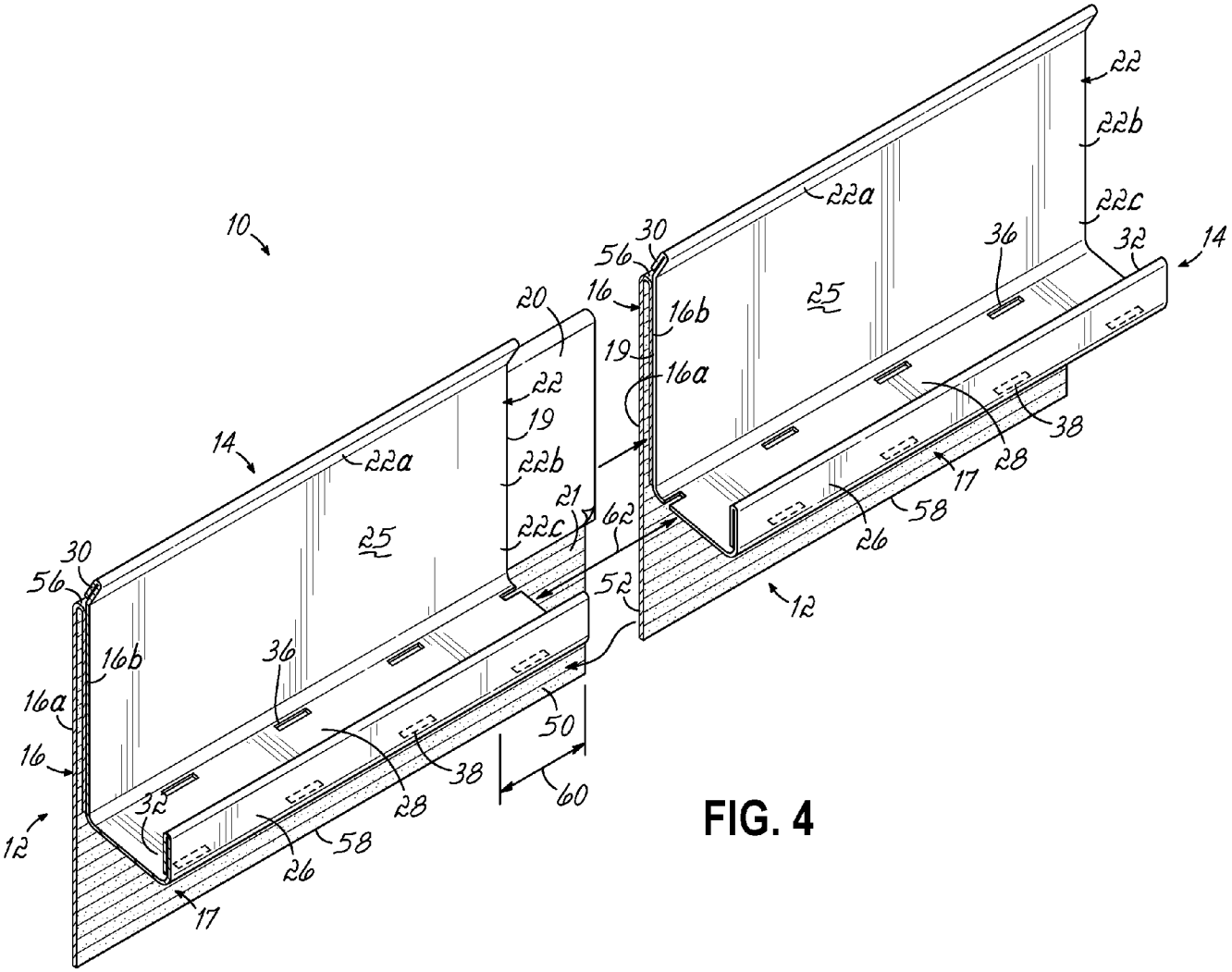
FIG. 4 is a schematic perspective view showing two starter strips prior to being joined together.
Figure 5:
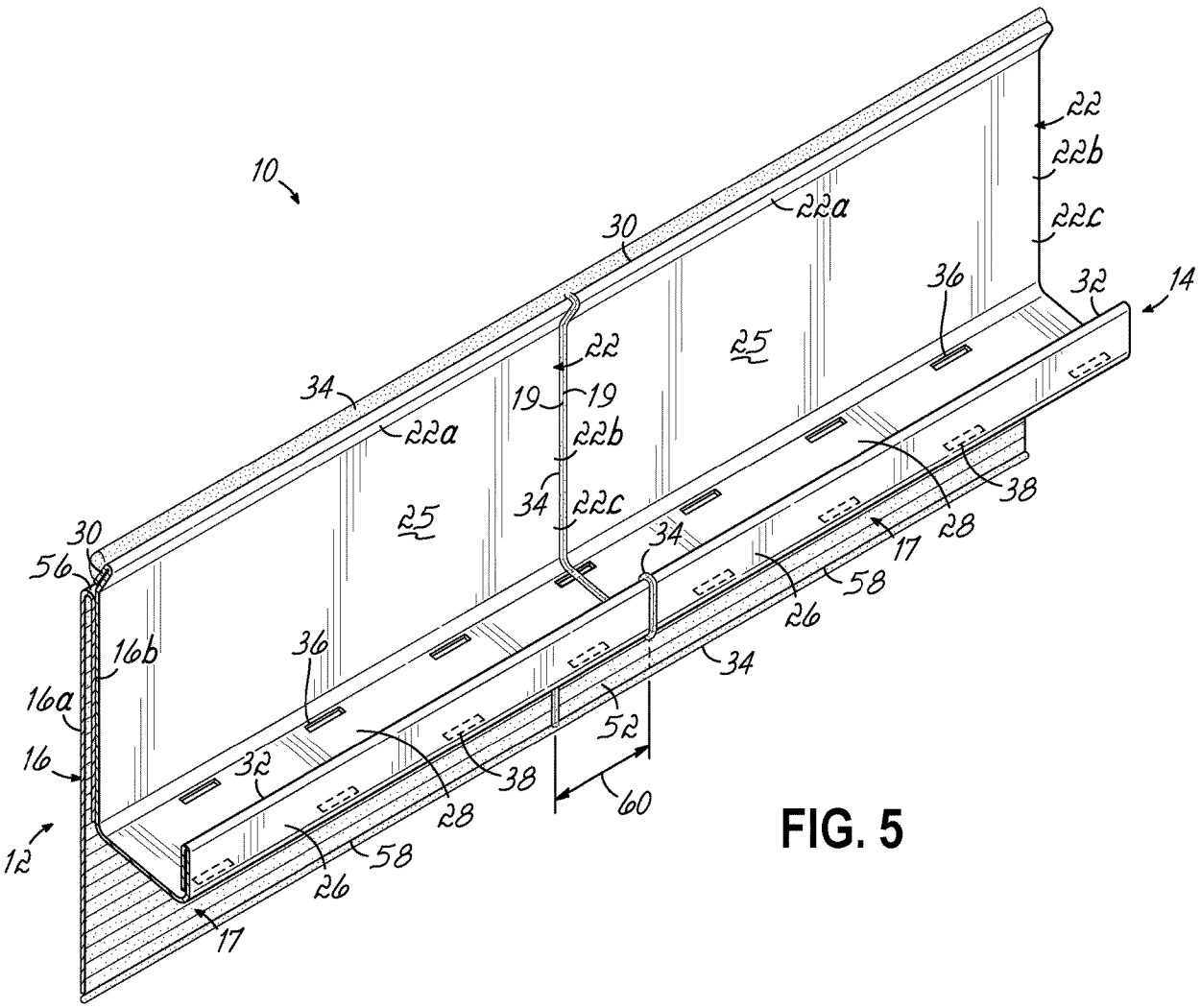
FIG. 5 is a schematic perspective view showing two starter strips after being joined together and sealed with a sealant at the terminal edges of the body and flashing membrane to provide continuity of protection.

As shown in FIGS. 4 and 5, an outer surface 50 of the overhang portion 21 is configured to permanently attach to the inner surface 52 of an adjacent flashing membrane 12. The terminal edge 19 of the body 14 is configured to butt against another terminal edge 19 of an adjacent body 14. As shown in FIG. 4, the terminal edge may split at least one of the first and second pluralities of spaced apertures 36, 38. The flashing membrane 12 is folded onto itself adjacent the upper angled portion 22*a* of the body 14, with the outer surface 17 forming an inverted U-shape, resulting in a continuous layer of flashing membrane 12. Termites and insect entry into a structure, from the space between the first vertical leg 22 and the wall substrate 18, is blocked along this top continuous fold 56 by the flashing membrane 12.

One exemplary installation method for the starter strip 10 for through-wall-flashing of a cement-based exterior finish and hard siding may include:

1) Storing the starter strip 10 in its shipping bundle to protect the starter strip 10 from elemental, impact, and compression damage until use. An installer may also confirm that the flashing membrane 12 is properly folded onto itself on the inner surface 24 of the first vertical leg 22 of the body 14.
2) Preparing the one or more wall substrates 18 that will be receiving the flashing membrane 12 to be structurally sound, dry, clean, and frost free.
3) Removing the first independent section 20*a* of the release paper 20 to expose at least part of the first inner surface portion 16*a*. It may be beneficial to start the installation at a corner of the structure to reduce the number of joints and/or remove the release paper 20 from the approximate 6" leg of the flashing membrane 12, and position the piece on the wall substrate 18.
4) Adhering at least part of the first inner surface portion 16*a* to the at least one wall substrate 18. The installer may check for adhesion of the flashing membrane 12 to the wall substrate 18. If the flashing membrane 12 can be peeled away from the wall substrate 18 after rolling (as described below), then a spray adhesive, such as 3M Super 77™ Multipurpose Spray Adhesive commercially available from The 3M Company of Maplewood, Minn., may be applied to the wall substrate 18. This process is continued until reaching the end of the starter strip 10.
5) Cutting and removing the overhang portion 21 of the flashing membrane 12 if applicable.
6) Butting the terminal edges 19 of two adjacent bodies 14 together as shown by arrow 62 in FIG. 4.
7) Permanently attaching an outer surface 50 of the overhang portion 21 to the inner surface 52 of an adjacent flashing membrane 12, by compressing the inner surface 52 of the second starter strip against the outer surface 50 of the overhang portion 21 already in-place. The installation is planned so that the overhang portion 21 will either wrap around the next corner or be cut and sealed to end the coverage with a bead of sealant 34.
8) Removing the second independent section 20*b* of the release paper 20 to expose a different part of the first inner surface portion 16*a*, and shaping and adhering the remainder of the first inner surface portion 16*a* of the flashing membrane 12 onto the wall substrate 18.
9) Using a hand-held, hard-surfaced roller (not shown) to compress the outer surface 25 of the body 14 and/or the outer surface 17 of the flashing membrane 12 to establish intimate contact between the flashing membrane 12 and the wall substrate 18.
10) Applying a bead of sealant 34 into the cavity between the upper angled portion 22*a* of the first vertical leg 22 and the at least one wall substrate 18. A bead of sealant 34 may also be applied adjacent the terminal edges 58 of the flashing membrane 12 and the joint 60 of the overhang portion 21.
11) Tooling the bead of sealant 34 with a tool, such as a spatula or other suitable tool. The sealant will be shaped to shed water from the wall onto the face of the body 14.
12) Inserting exterior finish fasteners into the flashing membrane 12, which will self-seal as they penetrate.

One exemplary installation method for the starter strip intended to be a combination termite and insect guard, starter strip, and through-wall-flashing of a cement-based exterior finish and hard siding may include the above method in addition to possible aspects discussed below:

1) Applying a bead of sealant 34 into the cavity between the upper angled portion 22*a* of the first vertical leg 22 and the at least one wall substrate, so that, when tooled with a spatula, the bead of sealant 34 will be shaped to shed water from the wall onto the outer surface 25 of the body 14. (An STPU approved sealant is generally used with U.S. drainage lath cavity counter wall sheets in their application for rain screen and pressure equalized rain screen wall assemblies.)
2) Applying a bead of sealant 34 along the terminal edges 58 of the flashing membrane 12 and along the joint 60.
3) Inspecting annually the exposed sealant application and flashing membrane 12. It is desirable to replace or repair any damaged or deteriorated material with the originally specified materials.
4) Inspecting annually the area between grade and the starter strip for termite mud tunnels and other indications of insect activity. For example, this includes destroying visible mud tunnels and monitoring for continued activity. If any activity continues, an exterminator may be contacted.

The starter strip 10 provides many benefits, a few of which are described below. According to various embodiments, the starter strip:

1) Blocks termite and insect upward movement at lower wall entry points in a cement-based exterior finish 27.
2) Starts and flashes construction of a cement-based exterior finish using a single product rather than two or more standalone products, with the two products being an independent starter strip and a separate through wall flashing membrane. When multiple products are used, especially when installed by different installers, the risk of misinstallation or inadequate protection against water and/or terminates and other insects dramatically increases.
3) Fully integrates with interfacing vapor and moisture barrier materials. According to an exemplary embodiment, the starter strip 10 fully integrates with interfacing waterproofing materials.
4) Blocks air infiltration at the foundation to wall interface.
5) Offers superior ultraviolet, weather, and salt resistance.

While this invention has been illustrated by a description of exemplary embodiments and while these embodiments have been described in some detail, it is not the intention of the inventor to restrict or in any way limit the scope of the appended claims to such detail. Additional advantages and modifications will readily appear to those skilled in the art. The various features of the disclosure may be used alone or in any combination depending on the needs and preferences of the user. This has been a description of this invention, along with the methods of practicing this invention as currently known. However, the invention itself should only be defined by the appended claims.

What is claimed is:

1. A starter strip for through-wall-flashing of a cement-based exterior finish and hard siding, the starter strip comprising:

a flashing membrane having an inner surface that includes first and second inner surface portions containing self-adhering adhesive, the first inner surface portion being configured to permanently attach to at least one wall substrate to form a first waterproof seal;

a body comprising:

a first vertical leg having an inner surface attached to the second inner surface portion of the flashing membrane to form a second waterproof seal, the first vertical leg including an upper portion and a lower portion;

a second vertical leg; and an outwardly and downwardly projecting leg extending between the lower portion of the first vertical leg and the second vertical leg, the outwardly and downwardly projecting leg including first and second pluralities of spaced apertures, wherein the first plurality of spaced apertures is disposed adjacent the lower portion of the first vertical leg and is configured to relieve cavity air pressure, and wherein the second plurality of spaced apertures is disposed adjacent the second vertical leg and is configured to drain water from the body;

wherein the flashing membrane is folded over on onto itself adjacent an upper angled portion of the body, with the inner surface forming an inverted U-shape, resulting in a continuous layer of flashing membrane between the first and second inner surface portions of the flashing membrane.

2. The starter strip of claim 1, further comprising:

a bead of sealant disposed between the upper portion of the first vertical leg and the at least one wall substrate, the bead of sealant configured to direct water to at least one of the first and second pluralities of spaced apertures.

3. The starter strip of claim 2:

wherein the body is integrally formed as a unitary piece, and wherein the inner surface of the first vertical leg is permanently attached to the second inner surface portion of the flashing membrane.

4. The starter strip of claim 2, wherein the upper portion of the first vertical leg and the second vertical leg include folded over portions, the folded portion of the upper portion of the first vertical leg extending outwards to form a channel to receive the bead of sealant.

5. The starter strip of claim 1:

wherein the first plurality of spaced apertures are spaced in a first row of identical rectangles, and wherein the second plurality of spaced apertures are spaced in a second row of identical rectangles.

6. The starter strip of claim 1, further comprising:

a mesh permanently attached to at least the outwardly and downwardly projecting leg, the mesh covering at least the first and second pluralities of spaced apertures, the mesh configured to allow water to drain while preventing termites and other insects from passing through.

7. The starter strip of claim 2, wherein the mesh is permanently attached to the first vertical leg, the outwardly and downwardly projecting leg, and the second vertical leg.

8. The starter strip of claim 1:

wherein the length of the flashing membrane is greater than the length of the body creating an overhang portion, an inner surface of the overhang portion being configured to permanently attach to the outer surface of an adjacent flashing membrane, and wherein a terminal edge of the body is configured to butt against an edge of an adjacent body.

9. The starter strip of claim 1, wherein the flashing membrane, the body, and the mesh include a layer of stainless steel to prevent termites and other insects from passing through.

10. The starter strip of claim 1, wherein the body is formed substantially from galvanized steel or stainless steel for cement-based exterior finishes.

11. The starter strip of claim 1, wherein the body is formed substantially from aluminum for hard siding.

12. The starter strip of claim 1, wherein the inner surface of the flashing membrane is covered by a release paper configured to protect the self-adhering adhesive prior to use.

13. The starter strip of claim 12, wherein the release paper is slit to enable removal in first and second independent sections.

14. A method of installing a starter strip for through-wall-flashing of a cement-based exterior finish and hard siding, the method comprising:

providing the starter strip, the starter strip comprising: a flashing membrane and a body, the flashing membrane having an inner surface that includes first and second inner surface portions containing self-adhering adhesive, the body comprising:

a first vertical leg having an inner surface attached to the second inner surface portion of the flashing membrane to form a second waterproof seal, the first vertical leg including an upper portion and a lower portion, a second vertical leg; and an outwardly and downwardly projecting leg extending between the lower portion of the first vertical leg and the second vertical leg, the outwardly and downwardly projecting leg including first and second pluralities of spaced apertures, wherein the first plurality of spaced apertures is disposed adjacent the lower portion of the first vertical leg and is configured to relieve cavity air pressure, and wherein the second plurality of spaced apertures is disposed adjacent the second vertical leg and is configured to drain water from the body;

wherein the flashing membrane is folded over on onto itself adjacent an upper angled portion of the body, with the inner surface forming an inverted U-shape, resulting in a continuous layer of flashing membrane between the first and second inner surface portions of the flashing membrane;

permanently attaching the first inner surface portion to at least one wall substrate to form a first waterproof seal; and dispensing a bead of sealant between the upper portion of the first vertical leg and the at least one wall substrate, the bead of sealant configured to direct water to the second plurality of spaced apertures.

15. The method of claim 14, wherein permanently attaching the first inner surface portion further comprises:

removing a first independent section of the release paper prior to permanently attaching the first inner surface portion to at least one wall substrate to form a first waterproof seal.

16. The method of claim 14, wherein after dispensing the bead of sealant, the method further comprises:

tooling the bead of sealant with a spatula to ensure the bead of sealant adheres to both the upper portion of the first vertical leg and the at least one wall substrate.

17. The starter strip of claim 1, wherein the first and second inner surface portions of the flashing membrane are integrally formed as a unitary piece.

* * * * *